US005682175A

United States Patent [19]

Kitamura

[11] Patent Number: 5,682,175

[45] Date of Patent: Oct. 28, 1997

[54] DATA DRIVER GENERATING TWO SETS OF SAMPLING SIGNALS FOR SEQUENTIAL-SAMPLING MODE AND SIMULTANEOUS-SAMPLING MODE

[75] Inventor: Kentaro Kitamura, Tokyo, Japan

[73] Assignee: NEC Corporation, Tokyo, Japan

[21] Appl. No.: 361,973

[22] Filed: Dec. 22, 1994

[30] Foreign Application Priority Data

Dec. 27, 1993 [JP] Japan ..... 5-331705

[51] Int. Cl.[6] ..... G09G 3/36

[52] U.S. Cl. ..... 345/98; 345/99; 345/100

[58] Field of Search ..... 345/88, 87, 98, 345/99, 100, 211, 212, 213, 94, 55; 359/54, 55; 348/790, 792, 793; 377/70, 74, 75, 76, 77, 79; 349/33, 34, 36, 37; H04N 1/14

[56] References Cited

U.S. PATENT DOCUMENTS 5,061,920 10/1991 Nelson ..... 345/98

5,252,957 10/1993 Itakura ..... 345/98

5,418,547 5/1995 Mizukata ..... 345/98

FOREIGN PATENT DOCUMENTS 0 319 661 6/1989 European Pat. Off. .

0 350 027 1/1990 European Pat. Off. .

*Primary Examiner*—Xiao Wu

[57] ABSTRACT

A data driver for a matrix display device includes a shift register circuit for sequentially shifting a sampling start pulse in response to a clock signal to produce a plurality of sampling signals. A plurality of sample/hold circuits sample display data in response to a sampling signal supplied thereto. The driver also includes a switching circuit which transfers each of the sampling signals to an associated one of the sample/hold circuits in a sequential-sampling mode and the selected signals to the sample/hold circuits such that one of the selected sampling signals is supplied in common to at least two of the sample/hold circuits.

6 Claims, 9 Drawing Sheets

DATA DRIVER GENERATING TWO SETS OF SAMPLING SIGNALS FOR SEQUENTIAL-SAMPLING MODE AND SIMULTANEOUS-SAMPLING MODE

BACKGROUND OF THE INVENTION

1. Field of the Invention

The present invention generally relates to a data driver for a matrix display device. More specifically, the present invention is directed to a data driver for a matrix display device, which is applicable to any of the sequential-sampling method and the simultaneous-sampling method.

2. Description of the Prior Art

A data driver for a matrix display device in which a data bus is positioned perpendicular to a scan bus is employed so as to apply a data voltage to this matrix display device. As shown in FIG. 1, the conventional data driver applicable to any of the sequential-sampling method and the simultaneous-sampling method is arranged by a shift register consisting of a plurality of shift stages $SR_1$ to $SR_n$ for sequentially shifting an entered sampling start pulse SP in response to the clock signal CLK, thereby outputting the sampling signals $S_1$ to $S_n$ in sequence. Further, this conventional data driver includes a plurality of sample/hold circuits $BF_1$ to $BF_n$ each sampling an associated one of display data signals R, G, B and outputting the sampled data signal voltage to an associated one of data buses $Q_1$ to $Q_n$. A timing selecting circuit is further provided which includes AND gates $G_1$ to $G_n$ entering the sampling signals $S_1$ to $S_n$ from the shift registers $SR_1$ to $SR_n$ under the control of a control signal EN and outputting the sampling signals $S_1'$ to $S_n'$ to the sample/hold circuits $BF_1$ to $BF_n$, respectively. This data driver is disclosed in, Japanese Laid-open Patent Application No. Hei 2-74990.

Operations of the conventional data driver will now be explained below with reference also to FIG. 2 and FIG. 3 which are timing charts in the sequential-sampling method and simultaneous-sampling method, respectively.

In the sequential-sampling method as shown in FIG. 2, when both the control signal EN and the sampling pulse SP are inputted, the sampling pulse SP causes the shift stages $SR_1$ to $SR_n$ to shift an active high level or H-level in sequence in response to the clock signal CLK, so that the sampling signals $S_1$ to $S_n$ are outputted in sequence from the shift stages $SR_1$ to $SR_n$, respectively. These sampling signals $S_1$ to $S_n$ are then entered into the logic gates $G_1$ to $G_n$. At this time, since the control signal EN is at the H-level, the sampling signals $S_1$ to $S_n$ are directly transferred to the sample and hold circuits $BF_1$ to $BF_n$ with this timing as the signal $S_1'$ to $S_n'$, respectively. At the timings of these sampling signals $S_1'$ to $S_n'$, the display data signals R, G, B are sequentially sampled, so that then the sampled display data signals are supplied to the data buses $Q_1$ to $Q_n$.

In the simultaneous-sampling method as shown in FIG. 3 on the other hand, the control pulse signal EN having a certain time period is inputted and the sampling start pulse signal SP having the pulse width equal to three time periods as large as the clock signal CLK is inputted. Accordingly, the sampling signals $S_1$ to $S_n$ having the pulse width equal to three time periods of the clock signal CLK are outputted from the shift stages $SR_1$ to $SR_n$, respectively. Although these signals are supplied to the logic gates $G_1$ to $G_n$ of the timing selecting circuit, the control pulse signal EN causes three signals of the sampling signals $S_1'$ to $S_n'$ to be simultaneously outputted Thus, the outputted three sampling signals $S_1'$, $S_2'$ and $S_3'$ $S_4'$ $S_5'$ and $S_6'$ and so on are transferred to the corresponding three ones of the sample/hold circuits $BF_1$ to $BF_n$, so that three sets of the display data signals R, G and B are simultaneously sampled and thus transferred to the data buses $Q_1$ to $Q_n$.

As described above, this conventional data driver is applicable to both the sequential-sampling method and the simultaneous-sampling method. However, in order to realize the both applications, the pulse width of the sampling start pulse SP is required to be varied and the control pulse signal EN in synchronism with the clock signal CLK is also required to be changed. This means that the external peripheral circuits for producing these signals SP and EN are made complicated. Moreover, when the synchronization between the control signal EN and the clock signal CLK is shifted during the simultaneous sampling method, and hence the widths of three sampling signal outputted from the timing selecting circuit are fluctuated. There are some possibilities that four sets of the sampling signals are outputted at the same time. The display data signal cannot be thereby correctly sampled.

SUMMARY OF THE INVENTION

It is therefore an object of the present invention to provide an improved driver circuit.

Another object of the present invention is to provide such a data driver for a matrix display device in which switching in mode between a sequential-sampling operation and a simultaneous-sampling operation is carried out without complicated peripheral circuits.

A driver according to the present invention includes a shift register circuit sequentially shifting a sampling start pulse in response to a clock signal to thereby output a plurality of sampling signals, a plurality of sample/hold circuits each sampling display data in response to a sampling signal supplied thereto, and a switching circuit coupled between the shift register circuit and the sample/hold circuits and transferring the sampling signals from the shift register circuit to the sample/hold circuits, respectively, in a sequential-sampling mode and transferring selected ones of the sampling signals from the shift registers circuit to the sample/hold circuits such that one of the selected sampling signals is transferred in common to two or more ones of the sample/hold circuits in a simultaneous-sampling mode.

BRIEF DESCRIPTION OF THE DRAWINGS

The above and other objects, features and advantages of the present invention will be more apparent from the detailed description of the invention in conjunction with the accompanying drawings; in which.

DETAILED DESCRIPTION OF THE PREFERRED EMBODIMENTS

Figure 4:
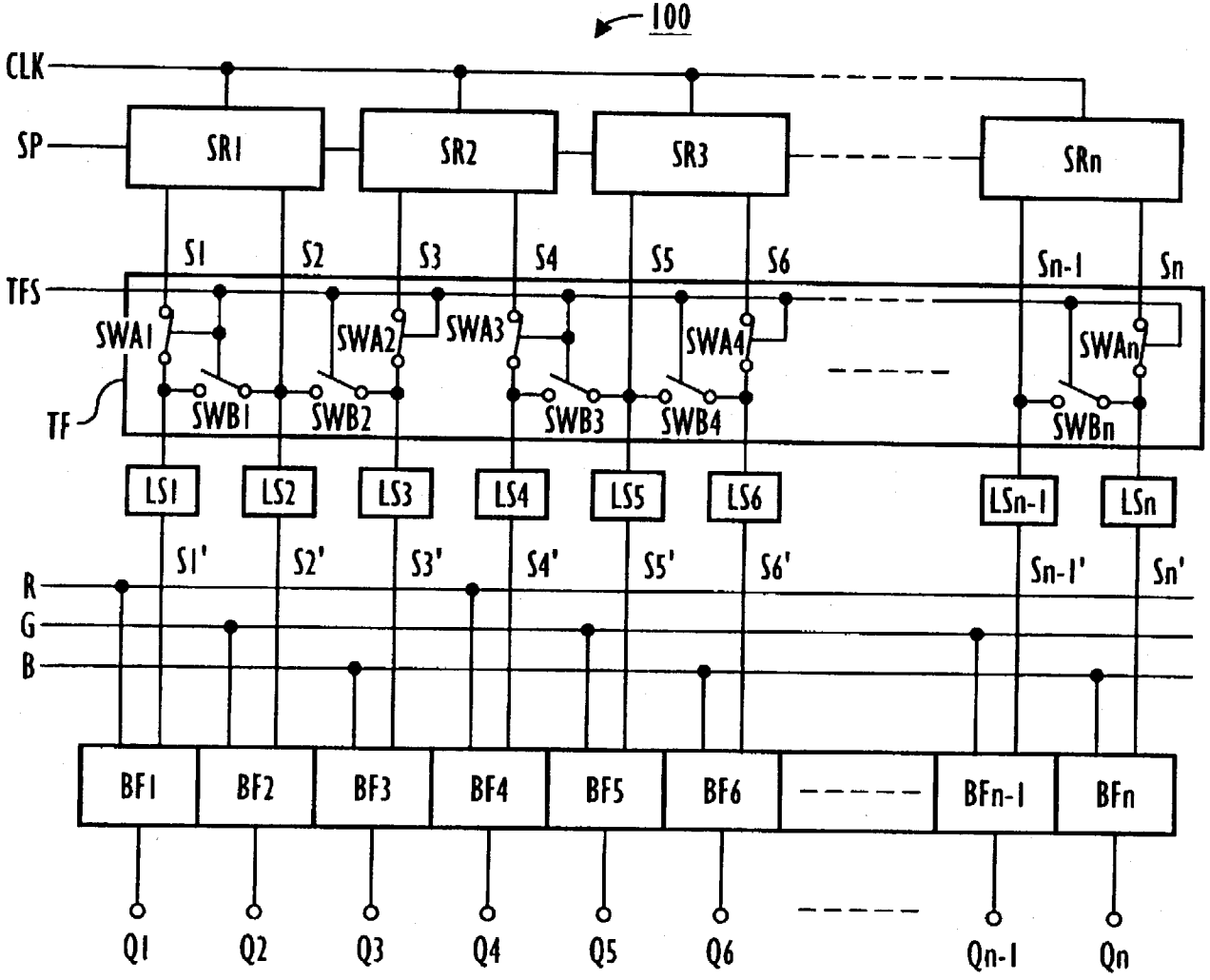
FIG. 4 is a schematic circuit diagram of a data driver for a matrix display device according to a first embodiment of the present invention.
Figure 6:
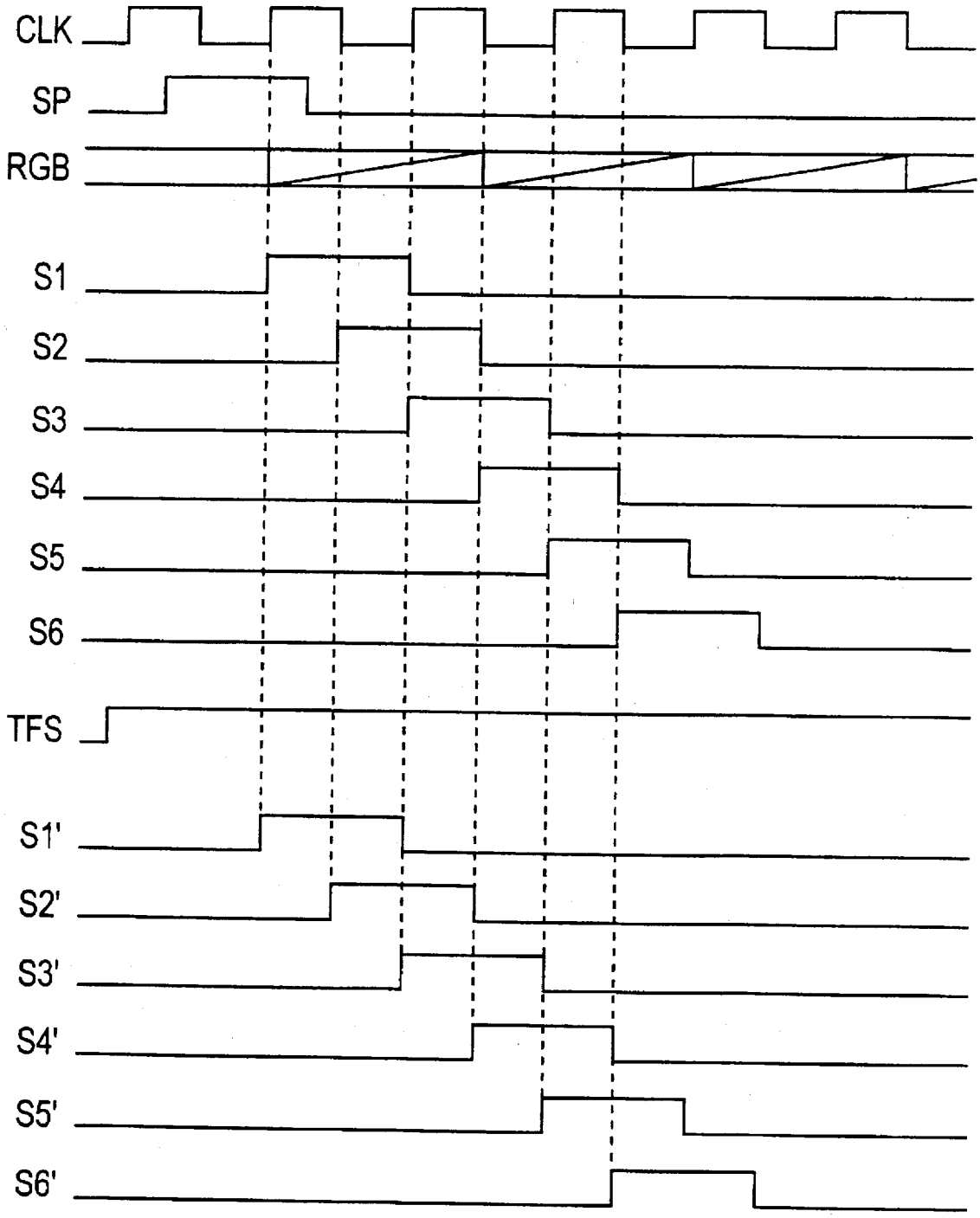
FIG. 6 is a timing chart for showing the operation of the circuit shown in FIG. 4 in a sequential-sampling method.

Referring now to FIG. 4, a data driver 100 for a matrix display device according to the first embodiment of the present invention includes n stages of shift registers $SR_1$ to $SR_n$ for sequentially shifting a sampling start pulse SP in response to a clock signal CLK. Each of the shift registers outputs associated two of sampling signals $S_1$ to $S_n$ with a relationship thereamong as shown in FIG. 6. For example, the shift register $SR_1$ responds to the active high level of the sampling start pulse SR and generates the sampling signal $S_1$ in synchronous with the leading edge of the clock signal CLK and further generates the sampling signal $S_2$ in synchronism with the trailing edge thereof. The driver 100 further includes n stages of sample/hold circuits $BF_1$ to $BF_n$ each sampling an associated one of display data signals R, G and B under the control of an associated one of sampling control signals $S_1'$ to $S_n'$ and outputting the sampled data signal voltage to the corresponding one of data buses $Q_1$ to $Q_n$.

Further included in this data driver 100 is a sampling switching circuit TF which receives the sampling signals $S_1$ to $S_n$ outputted from the shift registers $SR_1$ to $SR_n$ and a sampling switching signal TFS and outputs the sampling control signals $S_1'$ to $S_n'$, through level shift circuits $LS_1$ to $LS_n$. These level shift circuits $LS_1$ to $LS_n$ shift in level the sampling signals $S_1$ to $S_n$ to produce the sampling control signals $S_1'$ to $S_n'$ having a level suitable for driving the sample/hold circuits $BF_1$ to $BF_n$.

Figure 9:
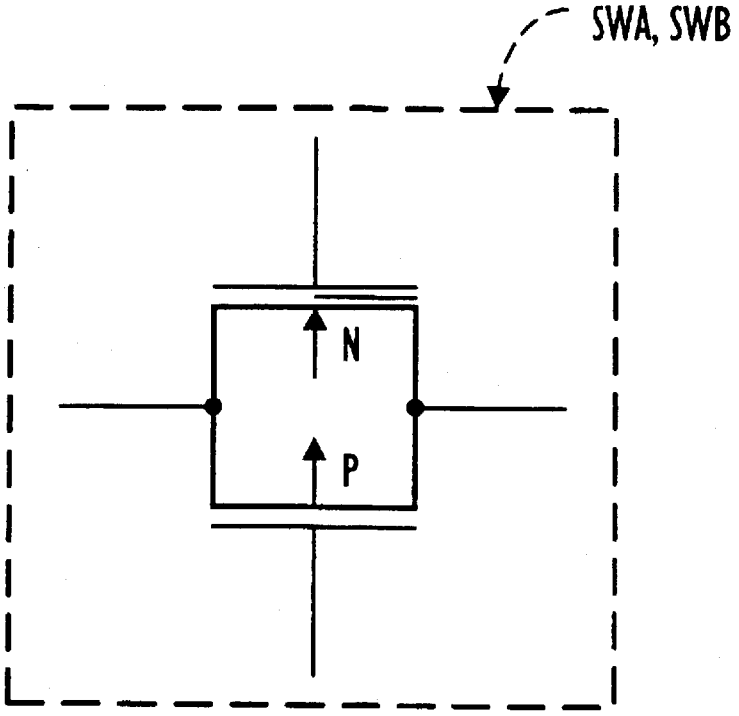
FIG. 9 is a circuit diagram showing each of analog switches SWA to SWB of FIGS. 4 and 5.

The sampling switching circuit provided in accordance with the present invention includes a plurality of analog switches $SWA_1$ to $SWA_n$ and $SWB_1$ to $SWB_n$ which are arranged as shown in the drawing, and each of which consists, as shown in FIG. 9 although not shown, of a p-channel MOS transistor and an n-channel MOS transistor connected in parallel to each other. If desired, each of the switch circuits SW can be composed of a transfer gate consisting of a single MOS transistor. Each of the switch circuits $ASWA_1$ to $SWA_n$ and $BSWB_1$ to $SWB_n$ is rendered conductive and non-conductive in accordance with the logic level of the sampling switching signal TFS. In this embodiment, the H-level (high level) of the sampling switching signal TFS designates the sequential-sampling method and thus turns the switch circuits $ASWA_1$ to $SWA_n$ ON and the switch circuits BSWB, to $SWB_n$ OFF. Accordingly, as shown in FIG. 6, the sampling signals $S_1$ to $S_n$ outputted from the shift registers $SR_1$ to $SR_n$ passes through the sampling switching circuit TF as they are, and then transferred via the level shift circuits $LS_1$ to $LS_n$ to the sample/result, hold circuits $BS_1$ to $BF_n$ as sampling signals $S_1'$ to $S_n'$ with keeping the present timings, respectively. As a result, the sample/hold circuits $BF_1$ to $BF_n$ sequentially sample display data signals R, G and B is response to the corresponding timings designated by the sampling signals $S_1'$ to $S_n'$, respectively. The display data signals thus sampled are then supplied to the data buses $Q_1$ to $Q_n$. The sequential-sampling operation is thus performed.

Figure 7:
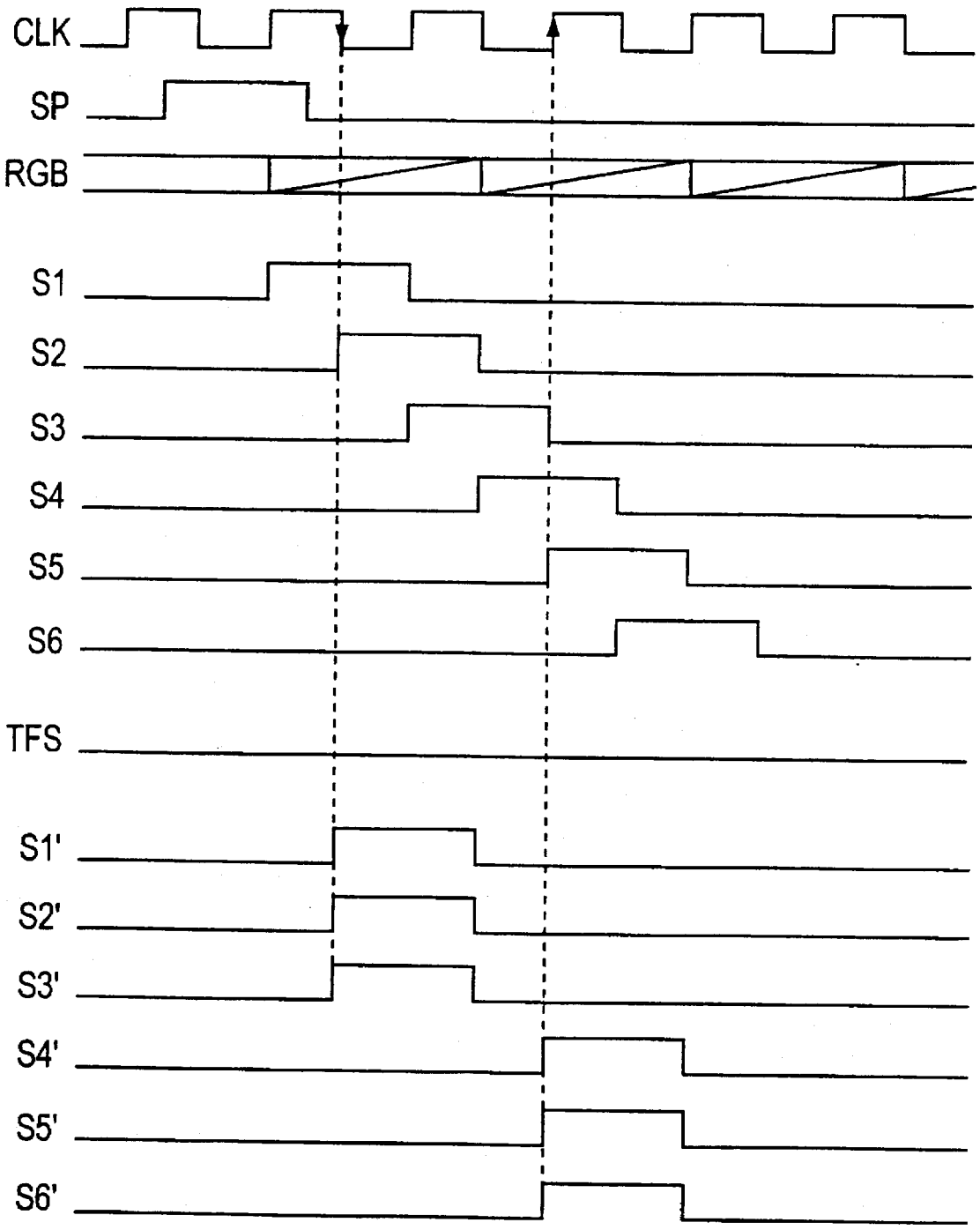
FIG. 7 is a timing chart for indicating the operation of the circuit shown in FIG. 4 in a simultaneous-sampling method.

On the other hand, when the simultaneous-sampling method is designated, the sampling switching signal TFS is changed to be the L-level (low level). The switch circuits $ASWA_1$ to $ASWA_n$ are thereby turned OFF, whereas the switch circuits $BSWB_1$ to $BWB_n$ are turned ON. As a consequence, as shown in FIG. 7, although the same sampling signals $S_1$ to $S_n$ as those of FIG. 6 are derived from the shift registers $SR_1$ to $SR_n$, sequential three ones of the sampling signals $S_1'$ to $S_n'$ are simultaneously outputted from the switching circuit TF at the same timings as those of the sampling signals $S_2, S_5, S_8, \ldots, S_{3n-1}$, respectively. The three ones of the sampling signals $S_1'$ to $S_n'$ thus output simultaneously are then transferred via the level shift circuits $LS_1$ to $LS_n$ to the corresponding three ones of the sample/hold circuits $BF_n$. The three sets of the display data signals R, G, B are thereby sampled at the same time and then outputted to the corresponding ones of the data buses $Q_1$ to $Q_n$.

Figure 1:
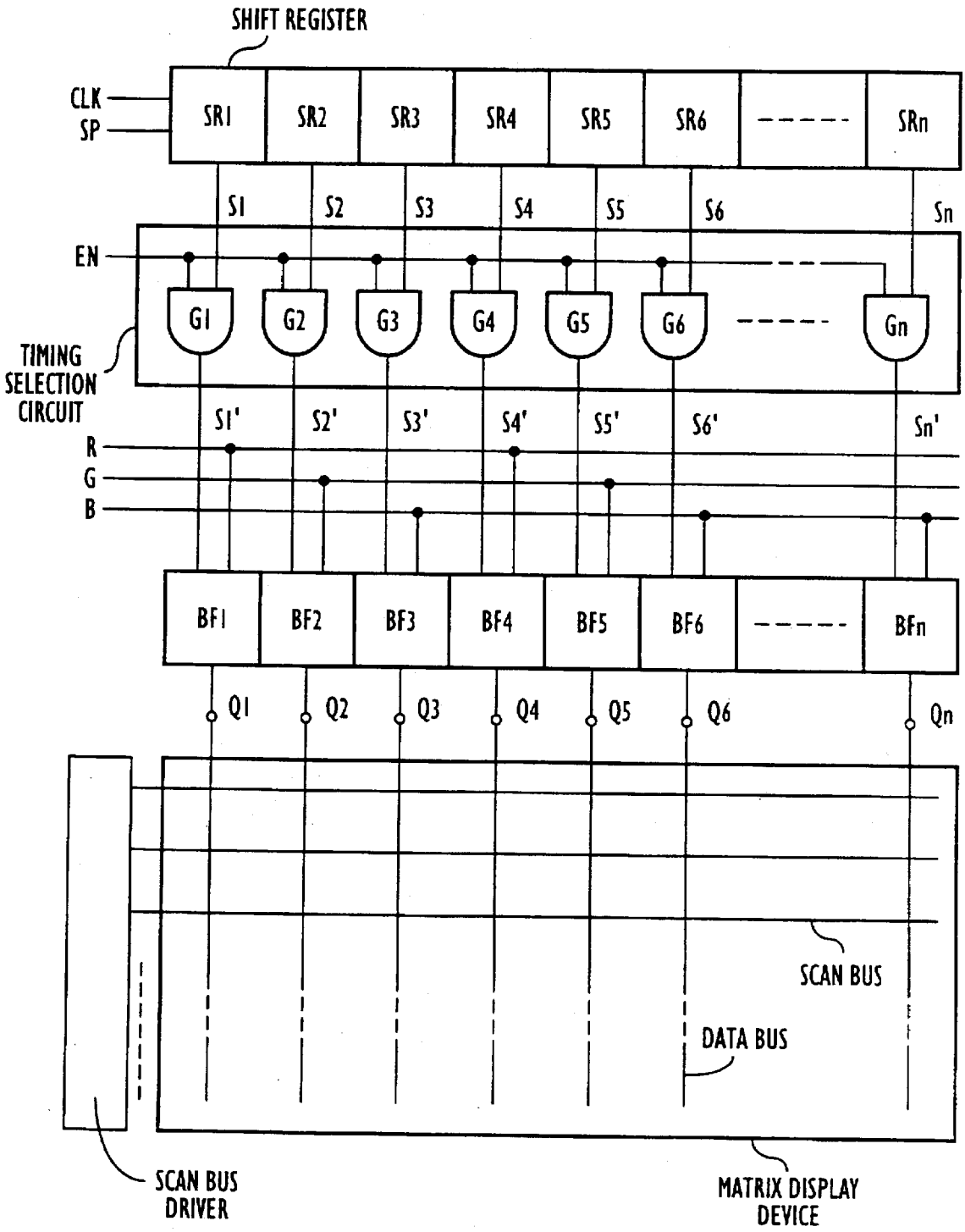
FIG. 1 PRIOR ART
FIG. 1 is a schematic block diagram for showing the arrangement of a conventional data driver for a matrix display device.
Figure 2:
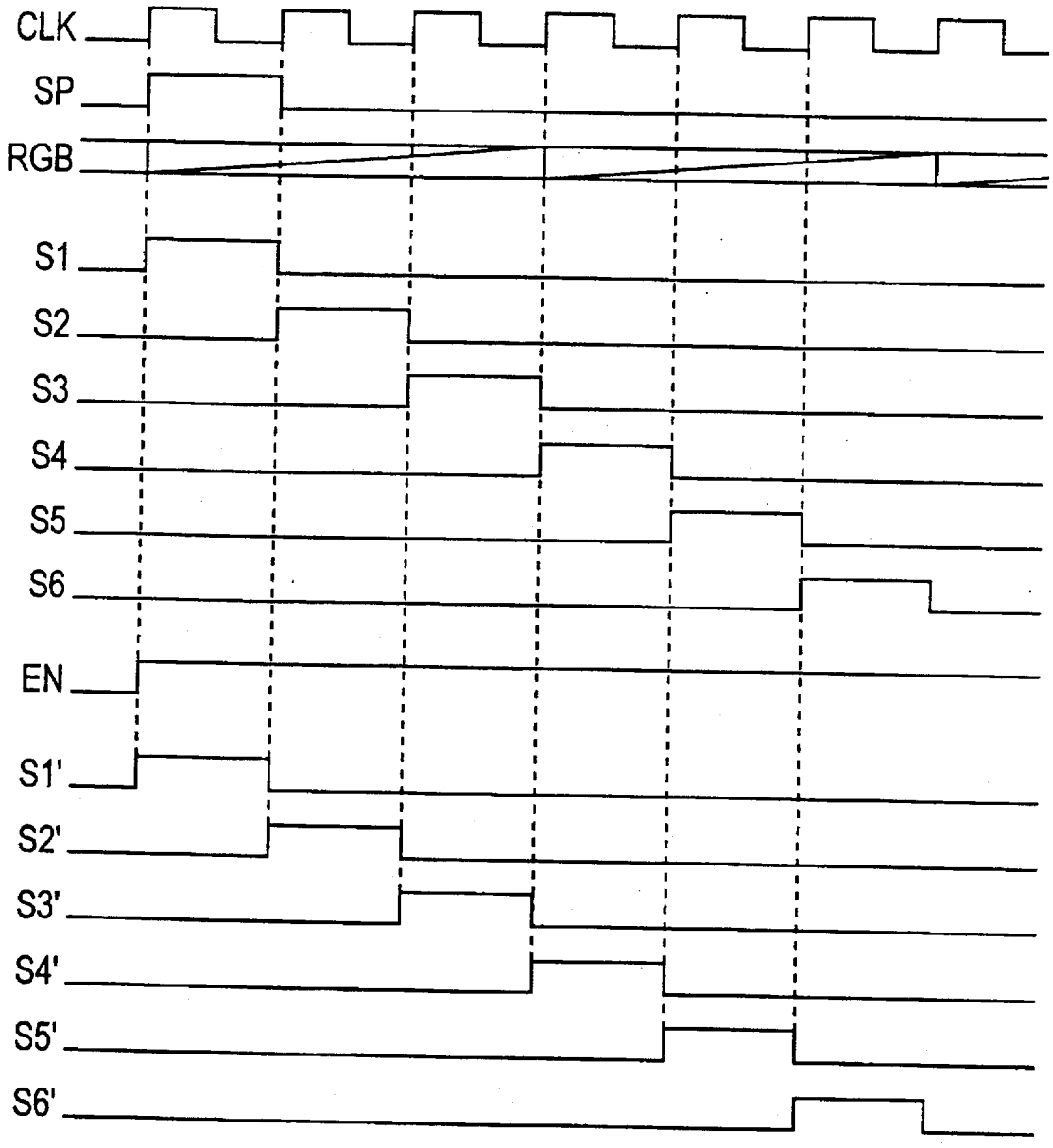
FIG. 2 PRIOR ART
FIGS. 2 and 3 are timing charts for indicating operations of the data driver shown in FIG. 1.
Figure 3:
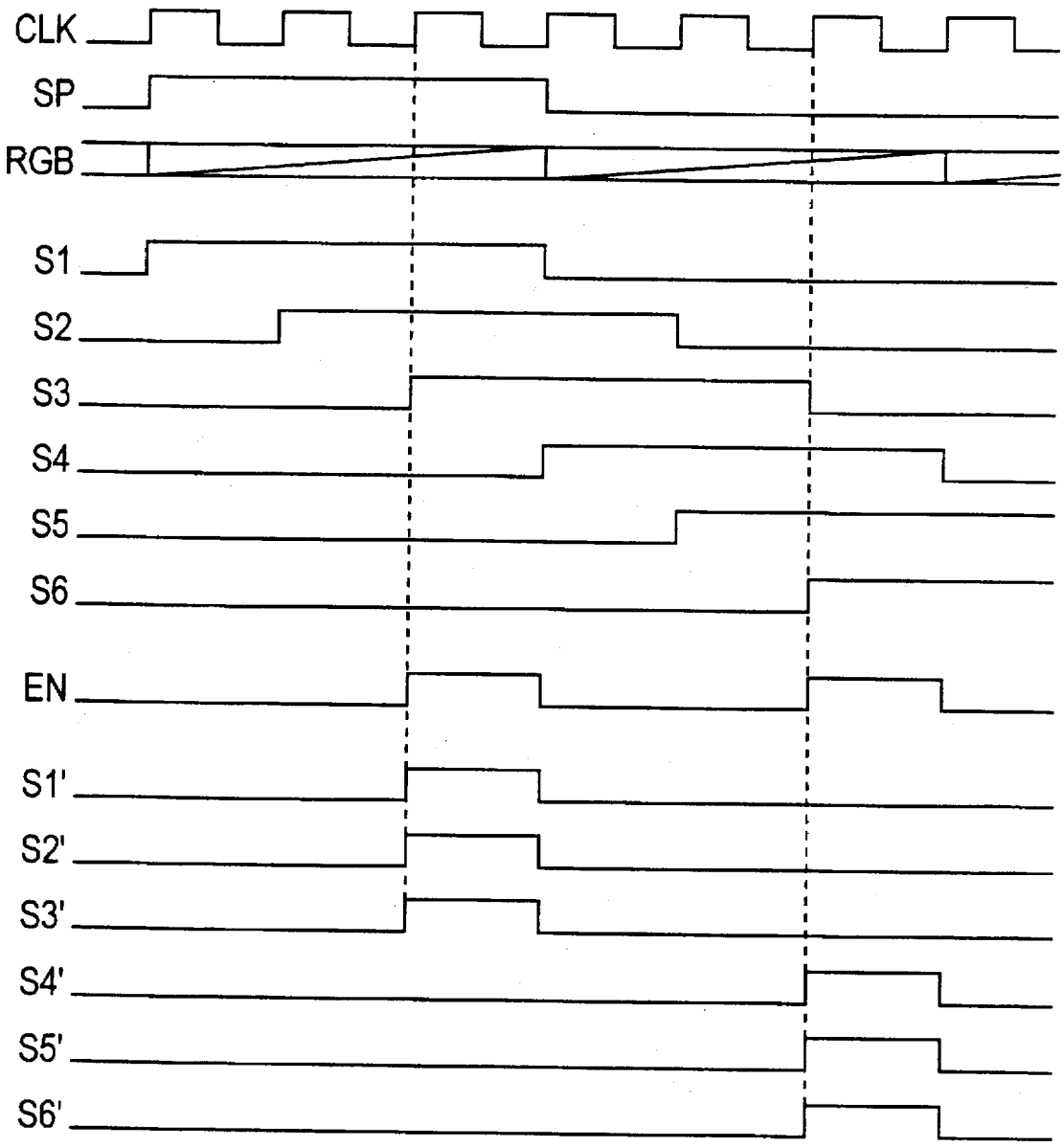
FIG. 3 PRIOR ART

In such a manner as described above, one of the sequential-sampling and simultaneous-sampling method is designated only by the level of the signal TFS. Moreover, this signal TFS is free from being synchronized with the clock signal CLK, and no change or control in level and is required to the signals SP and EN (FIG. 1). Accordingly, it is possible to realize the data driver for the matrix display device, capable of switching the sampling signals $S_1$ to $S_n$ outputted from the shift registers $SR_1$ to $SR_n$ and of being applied to any of the sequential-sampling method and the simultaneous-sampling method.

Figure 5:
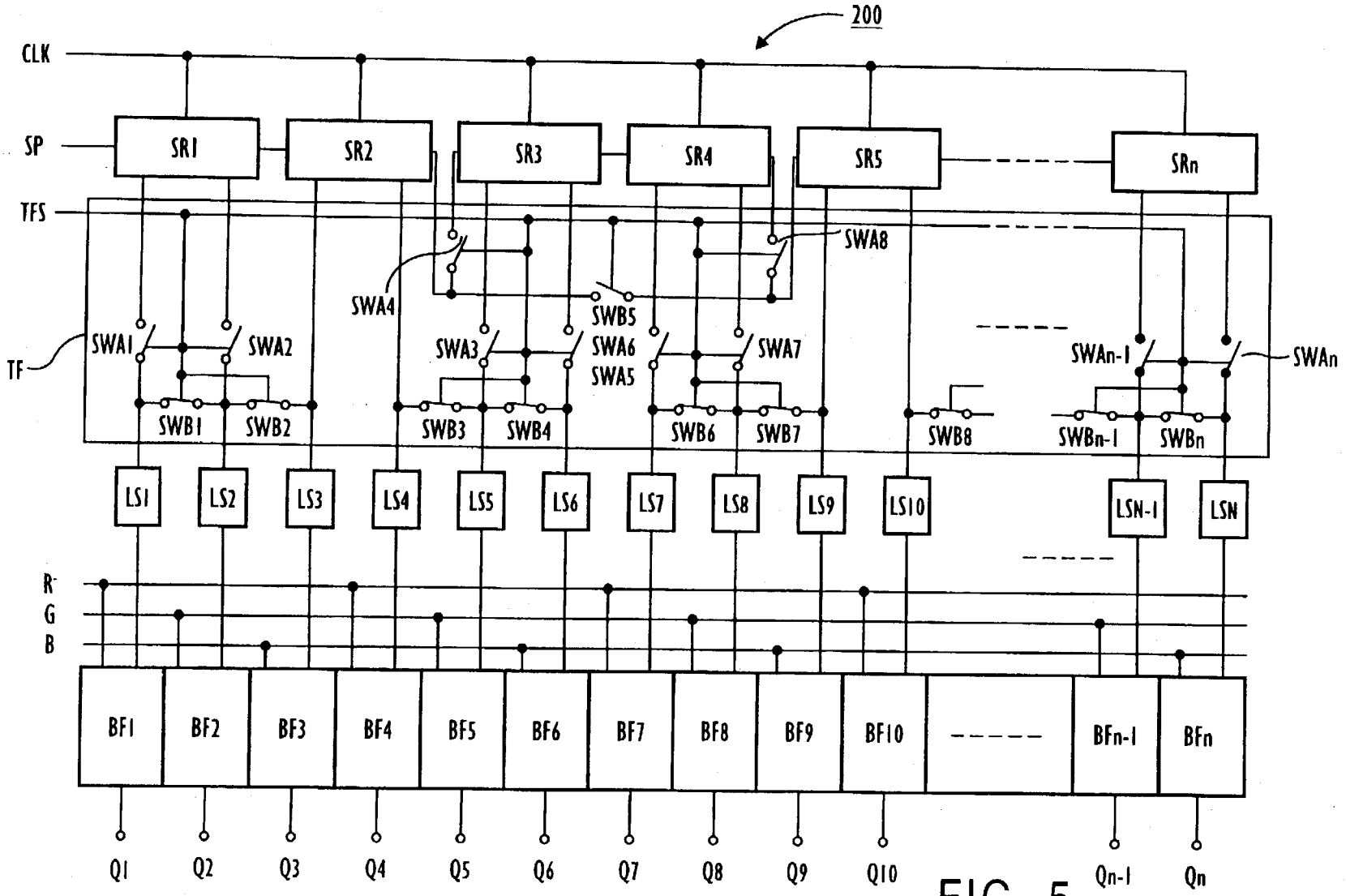
FIG. 5 is a schematic circuit diagram of a data driver for a matrix display device according to a second embodiment of the present invention.

Turning to FIG. 5, a data driver 200 according to the second embodiment of the present invention is constructed by employing such a sampling switching circuit TF that when a sampling switching signal TFS not synchronized with the clock signal CLK is inputted into this sampling switching circuit TF, the sampling signals $S_1$ to $S_n$ derived form the shift registers $SR_1$ to $SR_n$ and the sampling start pulse SP derived from the shift registers $SR_2, SR_4, SR_6, \ldots, SR_{2n}$ are switched. Accordingly, the sampling method of this data driver can be switched to either the sequential-sampling method or the simultaneous-sampling method.

When the sampling switching signal TFS takes the H-level to designate the sequential-sampling method, the switch circuits $SWA_1$ to $SWA_n$ are turned ON, whereas the switch circuits $SWB_1$ to $SWB_n$ are turned OFF. Therefore, the sampling signals $S_1'$ to $S_n'$ are generated in sequence, similarly to that of the first embodiment as represented in the timing chart of FIG. 6.

Figure 8:
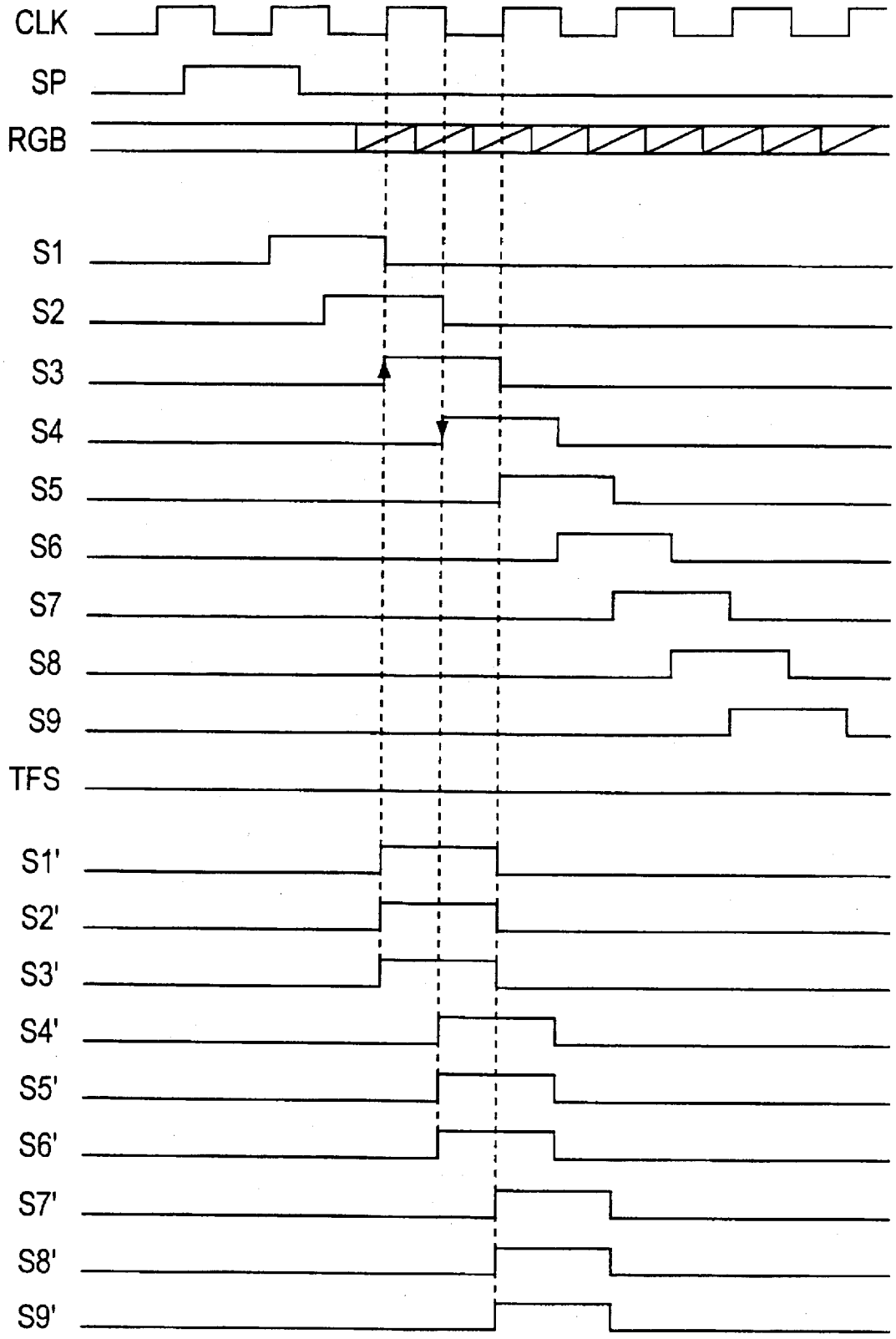
FIG. 8 is a timing chart for representing the operation of the circuit shown in FIG. 5 in the simultaneous-sampling method.

On the other hand, when the sampling switching signal TFS with the L-level is entered into the sampling switching circuit TF, both the sampling signals $S_1$ to $S_n$ outputted from the shift registers $SR_1$ to $SR_n$ and the sampling start pulse signal SP are switched, and the sampling signals $S_1'$ to $S_n'$ as indicated in FIG. 8 are transferred via the level shift circuits $LS_1$ to $LS_n$ to the sample/hold circuits $BF_1$ to $BF_n$. The simultaneous-sampling method is thus performed with the sampling speed that is three times as high as that of the first embodiment.

Since the sampling switching signal TFS with the H-level, or the L-level, which is not synchronized with the clock signal CLK, is supplied to the sampling switching circuit TF, both the sampling signals $S_1$ to $S_n$ derived from the shift registers $SR_1$ to $SR_n$ and the sampling start pulse SP are switched in a similar manner to that of the first embodiment. As a consequence, it is also possible to realize the data driver for the matrix display device applicable to any of the sequential-sampling method and the simultaneous-sampling method.

As previously explained in detailed, according to the present invention, the data driver for the matrix display device is provided with such a sampling switching circuit capable of switching both of the sampling signals derived from the shift registers and the sampling start pulse signal by inputting into this sampling switching circuit, the sampling switching signal with either the H-level or the L-level, which is not synchronized with the clock signal. As a consequence, there are such advantages that the sampling timing of the sample/hold circuit can be quickly and stably switched into any sampling timing of the sequential sampling method and the simultaneous sampling method without varying the pulse width of the sampling start pulse signal to be supplied to the shift register, and without supplying the independent control pulse signal synchronized with the clock signal to the sampling switching circuit.

It is apparent that the present invention is not limited to the above embodiments but may be modified and changed without departing from the scope and spirit of the invention. For example, the level shift circuits $LS_1$ to $LS_n$ may be omitted of the sampling signals derived from the switching circuit TF has a level sufficient to drive the sample/hold circuits $BF_1$ to $BF_n$.

What is claimed is:

1. A data driver for sampling display data and supplying sampled display data to a display device, comprising:

a shift register circuit for sequentially shifting a sampling start pulse in response to a clock signal to thereby produce a plurality of first sampling signals in sequence;

a plurality of sample/hold circuits each responding to an associated one of second sampling signals to sample said display data and supply sampled display data to said display device; and a switching circuit coupled between said shift register circuit and said sample/hold circuits and supplied with a control signal, said switching circuit transferring, when said control signal is maintained at a first logic level, said first sampling signals to said sample/hold circuits as said second sampling signals, respectively, and transferring, when said control signal is maintained at a second logic level, selected ones of said first sampling signals such that each of said selected ones of said first sampling signals is transferred in common to associated two or more of said sample/hold circuits, as the second sampling signals thereof.

2. The data driver as claimed in claim 1, wherein said switching circuit includes a plurality of level shift circuits each converting a level of one of said first sampling signals supplied thereto and producing a corresponding one of said second sampling signals.

3. The data driver as claimed in claim 1, wherein said switching circuit includes a plurality of switch circuits each formed of a transfer gate.

4. A data driver for sampling display data and supplying sampled display data to a display device, comprising:

a shift register circuit for sequentially shifting a sampling start pulse in response to a clock signal to thereby produce a plurality of first sampling signals in sequence;

a plurality of sample/hold circuits each responding to an associated one of second sampling signals to sample said display data and supply sampled display data to said display device; and a switching circuit coupled between said shift register circuit and said sample/hold circuits and supplied with a control signal, said switching circuit transferring said first sampling signals to said sample/hold circuits as said second sampling signals, respectively, when said control signal takes a first logic level and transferring selected ones of said first sampling signals to said sample/hold circuits such that one of said selected ones of said first sampling signals is transferred in common to associated ones of said sample/hold circuits when said control signal takes a second logic level, wherein said switching circuit includes a plurality of analog switches each formed of a P-channel MOS transistor and an N-channel MOS transistor.

5. A data driver comprising a plurality of sampling signal input terminals supplied respectively with a plurality of sampling signals, a plurality of sampling signal output terminals, a control terminal supplied with a control signal, a switching circuit coupled to said sampling signal input terminals, said sampling signal output terminals and said control terminal and including a plurality of switches arranged such that first ones of said switches are turned ON and second ones of said switches are turned OFF when said control signal takes a first logic level to cause said sampling signals to appear at said sampling signal output terminals, respectively, and that third ones of said switches are turned ON and fourth ones of said switches are turned OFF when said control signal takes a second logic level to cause at least one of said sampling signals to appear in common at two or more ones of said sampling signal output terminals; and a plurality of sample/hold circuits each coupled to an associated one of said sampling signal output terminals and sampling display data in response to a sampling signal appearing at said associated one of said sampling signal output terminals.

6. The data driver as claimed in claim 5, wherein said switches includes a plurality of first switches each connected between a selected one of said sampling signal input terminals and an associated one of said sampling signal output terminals and a plurality of second switches each connected between adjacent ones of said sampling signal output terminals.

* * * * *